US008449647B2

(12) United States Patent
Nam et al.

(10) Patent No.: US 8,449,647 B2
(45) Date of Patent: May 28, 2013

(54) METHOD OF INOCULATING MAGNESIUM ON COMPACTED GRAPHITE IRON, AND CYLINDER BLOCK AND CYLINDER HEAD MANUFACTURED BY USING THE METHOD

(75) Inventors: Won Soo Nam, Ulsan (KR); Heong Joo Park, Ulsan (KR); Jae Kee Lee, Ulsan (KR); Myoung Gu Hong, Ulsan (KR)

(73) Assignee: Hyundai Motor Company, Seoul (KR)

( * ) Notice: Subject to any disclaimer, the term of this patent is extended or adjusted under 35 U.S.C. 154(b) by 787 days.

(21) Appl. No.: 12/625,012

(22) Filed: Nov. 24, 2009

(65) Prior Publication Data

US 2011/0056077 A1 Mar. 10, 2011

(30) Foreign Application Priority Data

Sep. 9, 2009 (KR) ..... 10-2009-0084976

(51) Int. Cl.
*C21C 1/10* (2006.01)

(52) U.S. Cl.
USPC ..... 75/568; 75/584

(58) Field of Classification Search
USPC ..... 75/568, 584
See application file for complete search history.

(56) References Cited

U.S. PATENT DOCUMENTS

| | | | | |
|---|---|---|---|---|
| 2,158,510 | A * | 5/1939 | Lauer | 75/577 |
| 4,230,490 | A * | 10/1980 | Kessl | 420/20 |
| 6,508,981 | B1 * | 1/2003 | Perrin et al. | 420/28 |
| 2004/0042925 | A1 * | 3/2004 | Skaland | 420/20 |

FOREIGN PATENT DOCUMENTS

| | | | |
|---|---|---|---|
| JP | 58157946 | A * | 9/1983 |
| KR | 10-2002-0053877 | | 7/2002 |
| KR | 10-2005-0067610 | | 7/2005 |
| KR | 10-2006-0059392 | A | 6/2006 |
| KR | 10-2008-0042989 | A | 5/2008 |

* cited by examiner

*Primary Examiner* — George Wyszomierski
*Assistant Examiner* — Tima M McGuthry Banks
(74) *Attorney, Agent, or Firm* — Edwards Wildman Palmer LLP; Peter F. Corless; Konsik Kim

(57) ABSTRACT

A method of inoculating magnesium (Mg) on compacted graphite iron (CGI) comprises: providing a partition having a predetermined height on the bottom of a ladle so as to divide the interior of the ladle into a first space and a second space; laminating an Mg inoculant and a cover in order in the second space; and tapping liquid CGI cast iron onto the first space, whereby the Mg inoculant becomes in contact with the liquid CGI iron after the liquid CGI tapped onto the first space goes over the partition toward the second space and after the cover is melted by the liquid CGI. According to the method, the deviation of density of Mg is minimized, and a secondary inoculating process can thus be omitted.

3 Claims, 5 Drawing Sheets

<Prior Art>

<Prior Art>

<Prior Art>

METHOD OF INOCULATING MAGNESIUM ON COMPACTED GRAPHITE IRON, AND CYLINDER BLOCK AND CYLINDER HEAD MANUFACTURED BY USING THE METHOD

CROSS-REFERENCE TO RELATED APPLICATION

This application is based on and claims priority from Korean Patent Application No. 10-2009-0084976, filed on Sep. 9, 2009, the disclosure of which is incorporated herein in its entirety by reference.

BACKGROUND

1. Technical Field

The present disclosure relates to a method of inoculating magnesium (Mg) on compacted graphite iron (CGI), and a cylinder block and a cylinder head manufactured by using the method.

2. Related Art

Typically, a vehicle engine includes a cylinder block and a cylinder head. The cylinder block fixes a piston, a connecting rod, and a crank shaft and the cylinder head controls the flow of air, fuel, and combustion gas.

The cylinder block and head are manufactured by cast iron, more particularly, high-hardened hypereutectic compacted graphite iron (CGI). Such CGI is produced by preparing a pearlite matrix, which provides hardness, and inoculating 0.01~0.015 wt % of Mg on a hypereutectic composition that comprises 3.6~3.8 wt % of carbon (C), 1.9~2.1 wt % of silicon (Si), and the like, which facilitates vermiform graphite eruption.

CGI-based products are prepared by melting CGI cast iron of the above-described composition in a melting furnace; tapping the melted liquid to a ladle and simultaneously performing a primary inoculation with Mg; in the case where a high amount of Mg is detected through thermal analysis, discarding the liquid and performing the tapping and the primary inoculation again; and in the case where an additional amount of Mg is needed, performing a secondary inoculation with Mg wire, or measuring temperature and performing injection process into a mold.

However, in the conventional method of manufacturing a CGI product, an initial reaction of Mg proceeds rapidly in the primary Mg inoculating process, and the deviation of density of Mg becomes severe, so that the secondary inoculating process is required.

Also, since the conventional CGI cast iron is composed of a hypereutectic composition, high-temperature graphite eruption causes inferior liquidity, and the defect rate of casting contraction becomes high due to high-temperature injection.

The above information disclosed in this Background section is only for enhancement of understanding of the background of the invention and therefore it may contain information that does not form the prior art that is already known in this country to a person of ordinary skill in the art.

SUMMARY

One object of the present invention is to provide a method of inoculating Mg on CGI that can omit a secondary inoculating process by minimizing the deviation of the density of Mg through a maximum reduction of an initial reaction during the Mg inoculation.

Another object of the present invention is to provide a method of inoculating Mg on CGI that has a superior cast performance and processing performance in comparison to a hypereutectic CGI cast iron.

Still another object of the present invention is to provide a cylinder block and a cylinder head manufactured by using the above-described method.

In order to accomplish these objects, there is provided a method of inoculating magnesium (Mg) on compacted graphite iron (CGI), which includes the steps of: providing a partition having a predetermined height on the bottom of a ladle so as to divide the interior of the ladle into a first space and a second space; laminating an Mg inoculant and a cover in order in the second space; and tapping liquid CGI cast iron onto the first space. The Mg inoculant becomes in contact with the liquid CGI iron after the liquid CGI tapped onto the first space goes over the partition toward the second space and after the cover is melted by the liquid CGI.

The cover may be a plate made of wrought iron.

The height of the partition may be about ¼~⅓ of the height of the ladle.

The CGI includes iron (Fe) as the chief ingredient, 3.45~3.55 wt % of carbon (C), 2.30~2.40 wt % of silicon (Si), 0.30~0.35 wt % of manganese (Mn), 0.01~0.09 wt % of stannum (Sn), 0.02~0.04 wt % of chrome (Cr), 0.1~0.9 wt % of copper (Cu), 0.002~0.008 wt % of magnesium (Mg), and 0.02 wt % or less of sulfur (S).

A cylinder block and a cylinder head may be manufacture by using the above-described method.

The above and other features of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EMBODIMENTS

Figure 1:
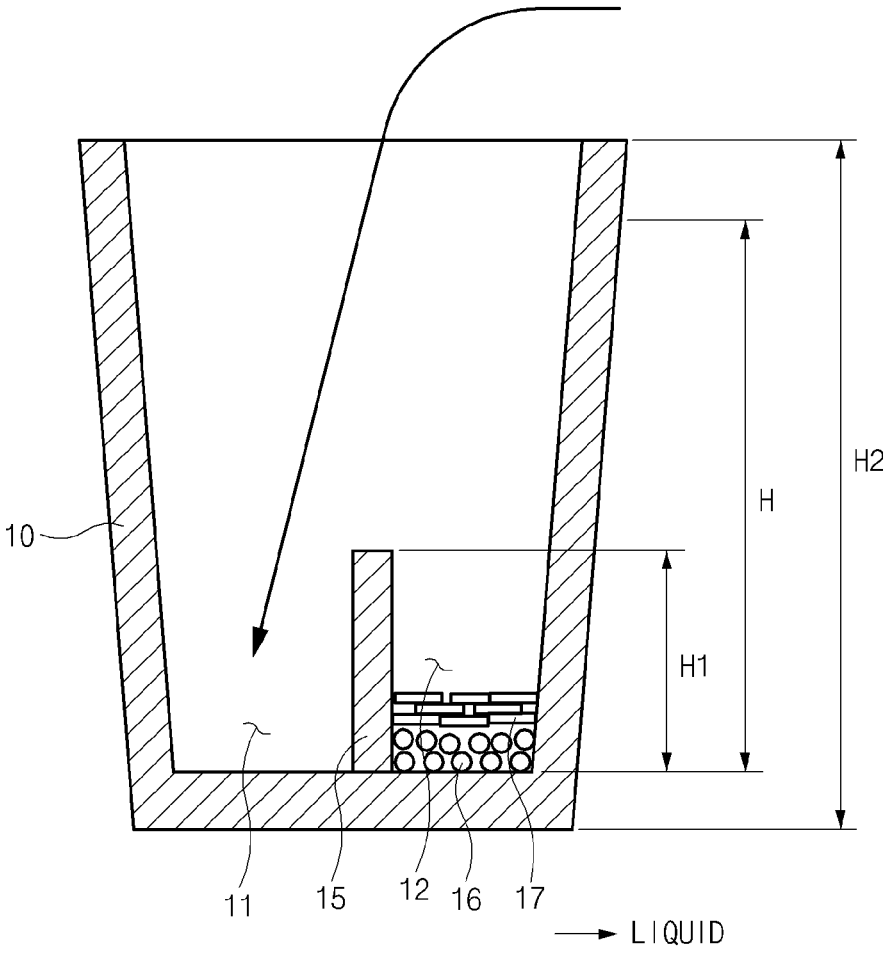
FIG. 1 is a schematic view illustrating a ladle used in a method of inoculating Mg on CGI according to the present invention.

Hereinafter, preferred embodiments of the present invention will be described in greater detail with reference to the accompanying drawings.

Compacted graphite iron (CGI) used in a method of inoculating MG on CGI according to the present invention includes iron (Fe) as the chief ingredient, 3.45~3.55 wt % of carbon (C), 2.30~2.40 wt % of silicon (Si), 0.30~0.35 wt % of manganese (Mn), 0.01~0.09 wt % of stannum (Sn), 0.02~0.04 wt % of chrome (Cr), 0.1~0.9 wt % of copper (Cu), 0.002~0.008 wt % of magnesium (Mg), and 0.02 wt % or less of sulfur (S).

Here, the reason for adding respective components included in the CGI and the reason for limiting the content range of the components will be explained as follows.

3.45~3.55 wt % of carbon (C) (1)

Carbon stabilizes the creation of CGI graphite, improves the liquidity of the liquid through eutectic compositions in association with Si content, and controls an excessive eruption of liquid graphite. In order to prevent the casting contraction, the content of carbon is limited to 3.45~3.55 wt %.

2.30~2.40 wt % of silicon (Si) (2)

Silicon (Si) increases time for possible graphite growth by maintaining the liquid in a eutectic temperature range of 1152° C. to 1115° C. during the solidification thereof, and thus can make stable vermiform graphite without fading with a small amount of Mg. Also, Si forms the eutectic compositions in association with the amount of carbon (C), and thus lowers the melting point of the liquid to improve the liquidity. If Si less than the above-described range is added, the vermiform graphite eruption and creation become unstable, whereas if Si more than the above-described range is added, the hardness thereof is heightened to deteriorate the processing performance.

0.1~0.9 wt % of Copper (Cu) (3)

While the solidified product is cooled to the eutectoid temperature of 727° C. after the completion of solidification in accordance with the Cu content, the ratio of ferrite of a matrix structure to a pearlite is determined by controlling the diffusion speed of carbon (C) in the matrix structure. If Cu less than the above-described range is added, a coarse pearlite is created to deteriorate the tensile strength, whereas if Cu more than the above-described range is added, only the hardness thereof is heightened without increasing the tensile strength to deteriorate the processing performance.

0.002~0.008 wt % of magnesium (Mg) (4)

Magnesium (Mg) is put into the liquid and forms fine bubbles by explosion. Mg is added for graphite nucleus creation and growth expedition, and makes the nucleus grow into vermiform graphite by surface tension according to the density of Mg in the liquid.

In the present invention, in order to improve the liquidity of the CGI cast iron, to prevent the contraction inferiority, and to create a stable vermiform graphite, the content of Mg is limited to 0.002~0.008 wt %. Like the conventional technique, if the amount of Mg is more than 0.008 wt %, a large quantity of bubbles is produced, and the surface tension of the liquid is heightened to facilitate the vermiform graphite creation and growth.

However, the graphite structure becomes inferior due to the deterioration of density of Mg in the course of time, the defect of casting contraction occurs due to the increase of the volume of the liquid, which is caused by the excessive graphite eruption and growth, and the liquidity is deteriorated due to the increase of viscosity of the liquid caused by the solid-state graphite eruption in the high-density Mg and liquid to cause the liquidity to be inferior.

On the other hand, if the amount of Mg is less than 0.002 wt %, flake graphite is created due to the lack of Mg bubbles and the deterioration of liquid viscosity, and thus the CGI cast iron cannot be made.

0.30~0.35 wt % of Manganese (Mn) (5)

Manganese (Mn) is added to stabilize the pearlite. If Mn less than the above-described range is added, a coarse pearlite is formed to deteriorate the tensile strength, whereas if Mn more than the above-described range is added, cementite is excessively formed over the above-described range to cause the increase of hardness, embrittlement, and contraction.

0.01~0.09 wt % of stannum (Sn) (6)

Stannum (Sn) is added to expedite the forming of cementite. If Sn less than the above-described range is added, a coarse pearlite is formed to deteriorate the tensile strength, whereas if Sn more than the above-described range is added, cementite is excessively formed over the above-described range to cause the increase of hardness and the formation of graphite by explosion.

0.02~0.04 wt % of chrome (Cr) (7)

Chrome (Cr) is added for fine grain of graphite. If Cr less than the above-described range is added, a coarse pearlite is formed to deteriorate the tensile strength, whereas if Cr more than the above-described range is added, cementite is excessively formed over the above-described range to cause the increase of hardness and embrittlement.

0.02 wt % or less of sulfur (S) (8)

Sulfur (S) supplements the vermiform graphite creation. However, if S more than the above-described range is put into the cast iron, it reacts on Mg and disturbs the creation of Mg bubbles and the temperature maintenance to make the vermiform graphite creation inferior.

A method of manufacturing cast iron products (i.e. cylinder block 20 and cylinder head 30) by using CGI cast iron of the above-described composition will now be described in order.

The CGI cast iron of the above-described composition is melted in a melting furnace, components in the furnace are inspected through an optical analysis and a CS analysis, and then the melted liquid is tapped onto a ladle 10 to perform Mg inoculation.

Here, a method of inoculating Mg on CGI cast iron will be described in more detail with reference to FIG. 1.

First, the ladle 10 for the Mg inoculation is prepared. In this case, a partition 15 of a specified height H1 is installed at a predetermined position of the bottom of the ladle 10 to divide the interior of the ladle 10 into a first space 11 and a second space 12. In the second space 12, an Mg inoculant 16 and a cover 17 are laminated in order.

In this case, the cover 17, which forms a plate made of wrought iron with a specified thickness, serves to prevent the Mg inoculant 16 from being in direct contact with the liquid tapped from the furnace.

Then, the liquid of the CGI cast iron is tapped onto the first space 11 of the ladle 10 as represented by the arrow shown in FIG. 1. If the liquid tapped onto the first space 11 goes over the uppermost end of the partition 15, and then comes into the second space 12, the cover 17 is first melted, and reacts on the MG inoculant 16 to complete the inoculation.

Here, it is preferable that the height H1 of the partition 15 is approximately ¼~⅓ of the height H2 of the ladle 10.

As described above, since an initial reaction of the liquid on the Mg inoculant 16 is not performed quickly (i.e. the liquid does not react on the Mg inoculant 16 until the liquid is filled up to a certain height, e.g., height H), but is performed slowly by the partition 15 and the cover 17, stable fine bubbles are created through putting of a small amount of Mg inoculant 16, and the CGI cast iron can be made without Mg fading since the Mg deviation is not severe and is kept constant.

Figure 2A:
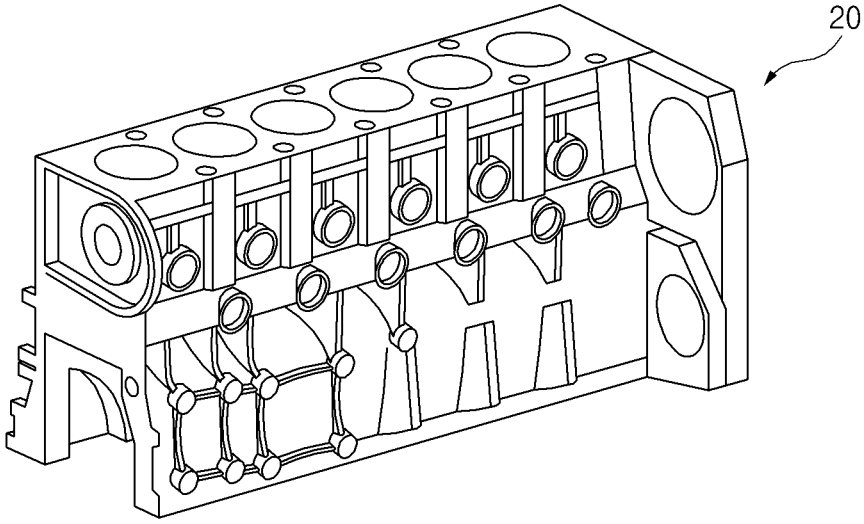
FIG. 2A shows a cylinder block manufactured by using the method of inoculating Mg on CGI according to the present invention.
Figure 2B:
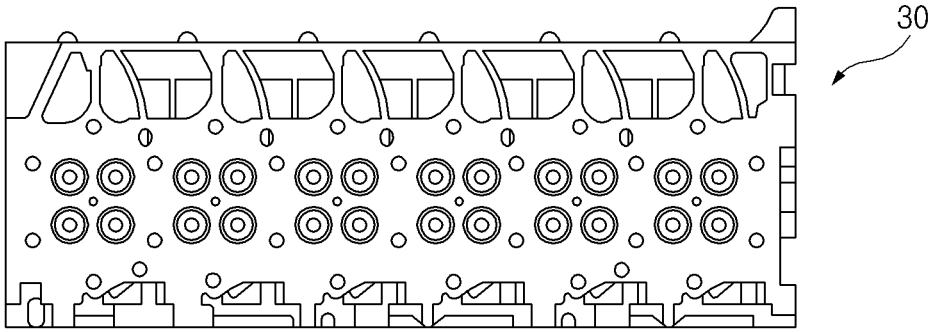
FIG. 2B shows a cylinder head manufactured by using the method of inoculating Mg on CGI according to the present invention.

Once the Mg inoculation on the ladle 10 is completed, the CGI cast iron is injected into a mold just after the injection temperature is measured, without any control process such as additional secondary inoculation, and thus a cylinder block 20 and a cylinder head 30 as shown in FIGS. 2A and 2B are manufactured.

Hereinafter, an embodiment of the CGI product (i.e. the cylinder block 20 or cylinder head 30) manufactured by using the Mg inoculating method according to the present invention will be described in more detail in comparison to comparative examples.

Example refers to a CGI cast iron product manufactured by using the Mg inoculating method according to the present invention and having superior cast performance and processing performance. Comparative Example 1 refers to a gray cast iron used as a material of a cylinder block and a cylinder head of a conventional engine, Comparative Example 2 refers to a conventional CGI cast iron used in a cylinder block of a high-horsepower engine, and Comparative Example 3 refers to a nodular cast iron used as a component material of an engine such as a crank shaft that requires hardness. Their components and composition are shown in Table 1 below.

TABLE 1

| | Chemical Components (wt %) | | | | | | | | |
|---|---|---|---|---|---|---|---|---|---|
| Classification | C | Si | Mn | P | S | Cu | Sn | Cr | Mg |
| Example | 3.46 | 2.33 | 0.30 | 0.032 | 0.015 | 0.47 | 0.036 | 0.034 | 0.006 |
| Comparative Example 1 | 3.51 | 1.91 | 0.59 | 0.057 | 0.091 | 1.08 | 0.097 | 0.015 | — |
| Comparative Example 2 | 3.67 | 2.25 | 0.28 | 0.030 | 0.01 | 0.90 | 0.72 | 0.28 | 0.006 |
| Comparative Example 3 | 3.72 | 2.56 | 0.50 | 0.01 | 0.018 | 0.32 | — | 0.041 | 0.035 |

Tensile/hardness test and metal structure inspection were carried out with respect to specimens of the Example and Comparative Examples 1 to 3. The results of the test and inspection are as shown in FIG. 3, and graphite forms and matrix structures are as shown in FIG. 4.

Figure 3:
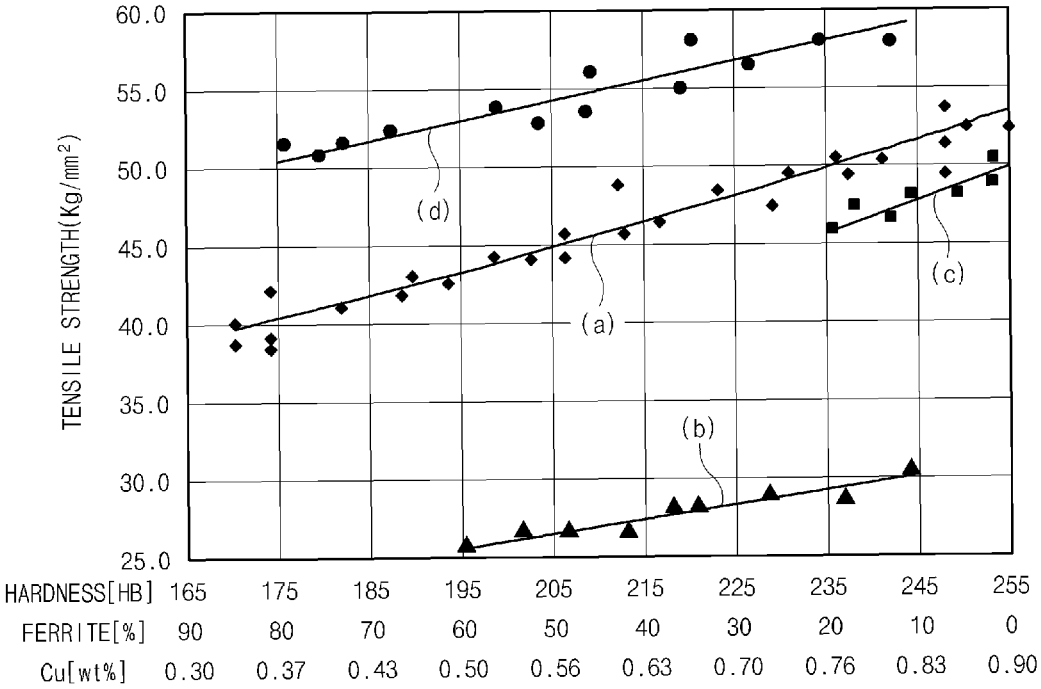
FIG. 3 is a graph showing a tensile test and a hardness test of CGI manufactured by using the method of inoculating Mg on CGI according to the present invention in comparison to Comparative Examples 1 to 3.
Figure 4A:
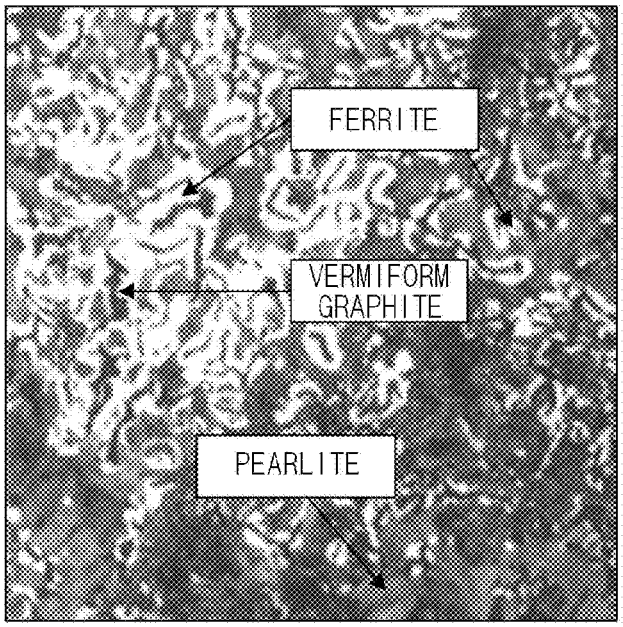
FIG. 4A shows the structure of CGI manufactured by the method of inoculating Mg on CGI according to the present invention.
Figure 4B:
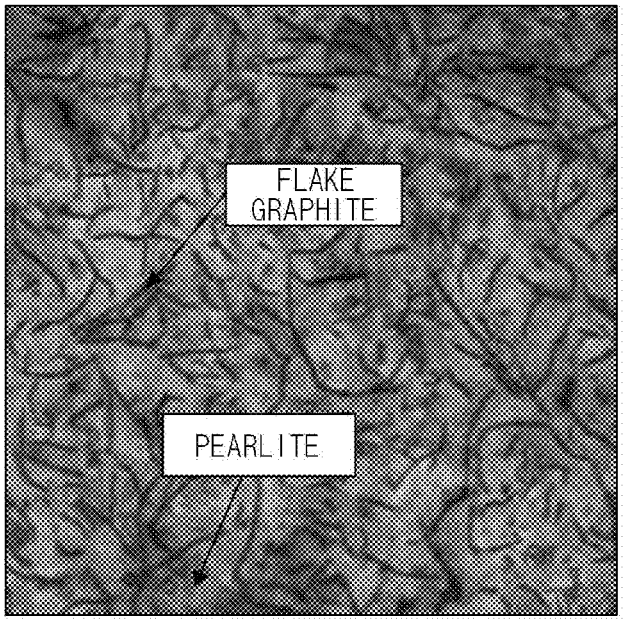
FIG. 4B shows the structure of CGI according to Comparative Example 1.
Figure 4C:
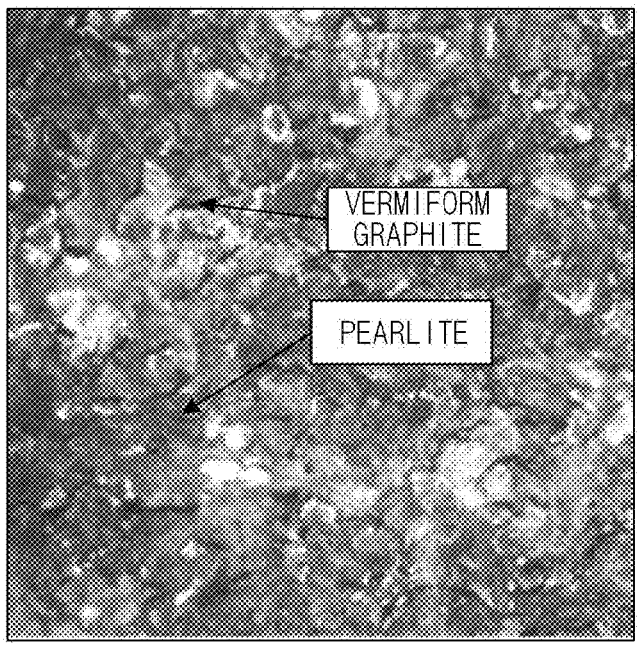
FIG. 4C shows the structure of CGI according to Comparative Example 2.
Figure 4D:
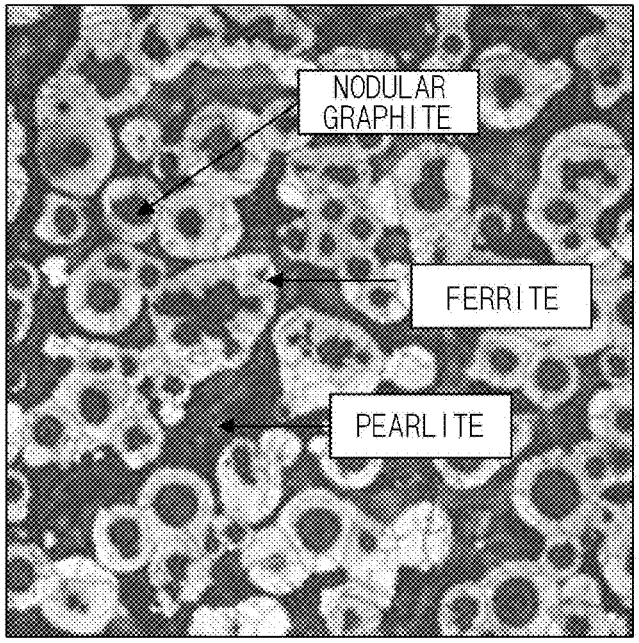
FIG. 4D shows the structure of CGI according to Comparative Example 3.

As a result of the tensile test and structure inspection, the cast iron of Comparative Example 1 has very low tensile strength (See line (b) in FIG. 3), the cast iron of Comparative Example 2 has poor cast performance and processing performance and high hardness (See line (c) in FIG. 3), and the cast iron of Comparative Example 3 shows low hardness and high tensile strength, but has inferior casting contraction and liquidity, so that it is difficult to apply it to a complicated shape (See line (d) in FIG. 3). By contrast, the cast iron of Example has optimal properties over the whole region, and shows superiority in casting performance and processing performance (See line (a) in FIG. 3).

As described above, according to the present invention, the deviation of the density of Mg is minimized through a maximum reduction of an initial reaction during the Mg inoculation, and thus a secondary inoculating process can be omitted.

Also, compositions of the CGI cast iron are constructed through determination of proper threshold values thereof, and thus superior cast performance and processing performance can be obtained in comparison to the hypereutectic CGI cast iron.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A method of inoculating magnesium (Mg) on compacted graphite iron (CGI), comprising the steps of:

providing a partition having a predetermined height on the bottom of a ladle so as to divide the interior of the ladle into a first space and a second space;

laminating an Mg inoculant and a cover in order in the second space, the cover being a plate made of wrought iron; and tapping liquid CGI cast iron onto the first space, whereby the Mg inoculant becomes in contact with the liquid CGI iron after the liquid CGI tapped onto the first space goes over the partition toward the second space and after the cover is melted by the liquid CGI.

2. A method of inoculating magnesium (Mg) on compacted graphite iron (CGI), comprising the steps of:

providing a partition having a predetermined height on the bottom of a ladle so as to divide the interior of the ladle into a first space and a second space;

laminating an Mg inoculant and a cover in order in the second space; and tapping liquid CGI cast iron onto the first space, whereby the Mg inoculant becomes in contact with the liquid CGI iron after the liquid CGI tapped onto the first space goes over the partition toward the second space and after the cover is melted by the liquid CGI, and wherein the height of the partition is about ¼~⅓ of height of the ladle.

3. A method of A method of inoculating magnesium (Mg) on compacted graphite iron (CGI), comprising the steps of:

providing a partition having a predetermined height on the bottom of a ladle so as to divide the interior of the ladle into a first space and a second space;

laminating an Mg inoculant and a cover in order in the second space; and tapping liquid CGI cast iron onto the first space, whereby the Mg inoculant becomes in contact with the liquid CGI iron after the liquid CGI tapped onto the first space goes over the partition toward the second space and after the cover is melted by the liquid CGI, and wherein the CGI cast iron includes iron (FE) as the chief ingredient, 3.45~3.55 wt % of carbon (C), 2.30~2.40 wt % of silicon (Si), 0.30~0.35 wt % of manganese (Mn), 0.01~0.09 wt % of stannum (Sn), 0.02~0.04 wt % of chrome (Cr), 0.1~0.9 wt % of copper (Cu), 0.002~0.008 wt % of magnesium (Mg), and 0.02 wt % or less of sulfur (S).

* * * * *